US005405004A

United States Patent [19]

Vest et al.

[11] Patent Number: 5,405,004

[45] Date of Patent: Apr. 11, 1995

[54] TOOL AND PARTS TRAY

[76] Inventors: Gary W. Vest, 2395 Remsen Rd., Medina, Ohio 44256; Gary D. Saunders, 6721 W. River Rd., Vermillion, Ohio 44089

[21] Appl. No.: 92,572

[22] Filed: Jul. 16, 1993

Related U.S. Application Data

[63] Continuation of Ser. No. 855,534, Mar. 23, 1992, abandoned.

[51] Int. Cl.[6] ..... B65D 85/00

[52] U.S. Cl. ..... 206/350; 206/372; 206/818; 248/206.5; 335/285

[58] Field of Search ..... 206/350, 372, 373, 818, 206/338; 248/206.5, 309.4, 311.2; 335/285, 286, 295, 301

[56] References Cited

U.S. PATENT DOCUMENTS

| | | | |
|---|---|---|---|
| D. 199,580 | 11/1964 | Boyd . | |
| 425,768 | 4/1890 | Ezell | 335/285 |
| 425,768 | 4/1890 | Ezell . | |
| 1,933,894 | 11/1933 | Clink | 206/373 |
| 2,217,514 | 10/1940 | Henry | 335/285 |
| 2,652,702 | 9/1953 | Hintze . | |
| 2,880,015 | 9/1958 | Harben . | |
| 2,978,215 | 4/1961 | Shanok et al. | 335/285 |
| 2,988,410 | 6/1961 | Weisz | 206/818 |
| 3,405,377 | 10/1968 | Pierce | 335/285 |
| 3,416,761 | 12/1968 | Shanok et al. . | |
| 3,642,122 | 2/1972 | Von Ende | 335/285 |
| 3,773,212 | 11/1973 | Sekuler . | |
| 4,363,402 | 12/1982 | Gryzll | 206/818 |
| 4,484,682 | 11/1984 | Crow | 335/285 |
| 4,826,059 | 5/1989 | Bosch et al. | 206/350 |
| 4,989,734 | 2/1991 | Mode et al. | 206/818 |
| 5,080,230 | 1/1992 | Winnard | 206/350 |

FOREIGN PATENT DOCUMENTS

| | | | |
|---|---|---|---|
| 1348460 | 12/1963 | France | 206/818 |
| 2829440 | 1/1980 | Germany | 206/818 |
| 0430975 | 8/1967 | Switzerland | 335/285 |
| 0950274 | 2/1964 | United Kingdom | 335/285 |

OTHER PUBLICATIONS

Two photographs of a NAPA Magnet Tray; no date.

Two photographs of a Magne-Tray Magnetized Stainless Steel Tray; no date.

Photocopy of product flier attached to the NAPA Magnet Tray; no date.

Photocopies of front and backside of package box containing the Magne-Tray Magnetized Stainless Steel Tray; no date.

Photocopies of p. 110 and an unnumbered page of a 1990 NAPA BALKAMP Parts, Supplies and Accessories Catalog, p. 110 showing a NAPA Magnet Tray (Item G, Part No. 770-6031).

Photocopies of the front page and p. 359 of a 1992-1993 Matco Tool and Equipment Catalog, p. 359 showing a Magnetic Tool and Trouble Light Holder (Part No. MH2).

Photocopies of front page and an unnumbered page from a 1988-1989 Snap-On Catalog, the unnumbered page showing a Magnetic Parts Tray (Item AD, Part No. YA 347).

Photocopies of the index page and p. 37 of a Mac Tools, Inc. Catalog having a 1989 copyright, p. 37 showing a Magnetic Parts Tray (Part No. 347).

*Primary Examiner*—Jimmy G. Foster

*Attorney, Agent, or Firm*—Watts, Hoffmann, Fisher & Heinke Co.

[57] ABSTRACT

A tool tray for storing tools and small parts. The tray has a multiple number of compartments and a magnet that is attached to the tray to facilitate supporting the tray on a metal surface such as in a motor vehicle engine compartment. The magnet is supported in a ferromagnetic metal shield that is secured to the tray by a single connector such as a rivet. A circular compartment overlies the magnet so that small metal items such as nuts and bolts and the like are attracted to the magnet and tend to stay within the circular compartment.

2 Claims, 4 Drawing Sheets

TOOL AND PARTS TRAY

This application is a continuation of application Ser. No. 07/855,534, filed Mar. 23, 1992, now abandoned.

FIELD OF THE INVENTION

The present invention concerns a tool tray and more particularly concerns a container suited for storing tools and small parts used in repairing a motor vehicle.

BACKGROUND ART

Often when working on a motor vehicle, the repair person is in an awkward position under the hood which makes it difficult to reach an appropriate tool. If the repair person must get out from under the hood to get the tool and then reposition himself for the maintenance procedure, it is inefficient. Furthermore, it may be difficult to get back into the appropriate position while maintaining a grasp on the tool.

If the repair or maintenance person positions a tool tray in close proximity to the work position, it may be difficult to obtain the appropriate tool even though it is within ready reach. In the process of grasping for the tool, it is often the case that the tool tray is upset and its contents strewn over the work area.

The repair and maintenance of a motor vehicle often requires small parts to be removed and placed aside for later re-installation. During the repair, these small parts can be easily misplaced.

One object of the present invention is the provision of a tool and parts tray for storing tools and small parts used in repair and maintenance of a motor vehicle. The tool and parts tray allows tools to be placed within easy access of the person working on the motor vehicle. An additional object is to provide a place to hold small parts removed from the vehicle and to keep new parts that will be installed.

DISCLOSURE OF THE INVENTION

The present invention concerns a tool and parts tray particularly adapted for use in repairing a motor vehicle. A tray body has separate compartments for storing tools and small parts and is held in place by a magnet attached to the tray body. Suitable metal surfaces on the motor vehicle for supporting the tray include the top of the engine air cleaner or the engine compartment braces.

In accordance with a specific embodiment of the invention, a base of the tray body defines a cavity bounded by a generally planar outwardly facing surface of the body and the magnet used to fix the tray to this metal surface fits within this cavity. Preferably, the magnet is a round, generally disk-like magnet which fits within a suitable cylindrical cavity in the tray body. The preferred design uses a rivet passing through a non-magnetic tray body to affix the magnet in place. The preferred body is of a non-conducting material such as plastic and is formed by a molding process to define ribs which separate the body into compartments for storage of tools and small parts.

The preferred plastic body includes a rib that circumscribes a compartment for storing small metal items such as nuts, bolts and the like. This compartment is directly above the magnet so that, in addition to holding the tool tray to its support surface, the magnet attracts the nuts and bolts to keep them in their compartment as the tool tray is moved about.

In accordance with alternate embodiments of the invention, a tray body and magnet are connected by an adhesive or by means of projections that extend from the body. Additionally, the body can be metallic so long as a magnetic isolation is maintained between the tray body and the magnet.

The present invention allows the tray to be secured to a motor vehicle metallic component by means of the attraction between the magnet and the component. The tool tray is within ready reach of the repair or maintenance person and is securely fixed to the metal surface and is not easily upset by inadvertent or clumsy efforts to reach an appropriate tool.

These and other objects, advantages and features of the disclosed tool tray will become readily apparent from review of a detail description of three alternate embodiments of the invention which are described in conjunction with the accompanying drawings.

BEST MODE FOR PRACTICING THE INVENTION

Figure 1:
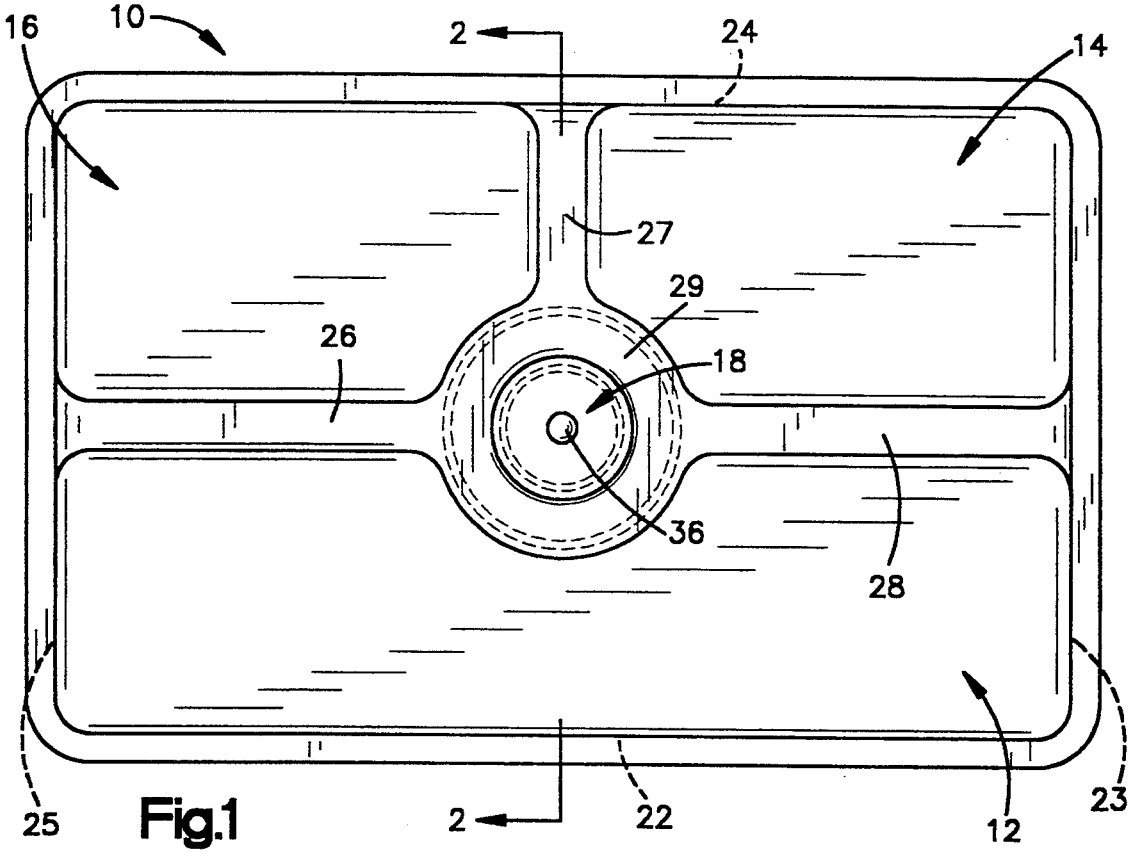
FIG. 1 is a plan view of a tool and parts tray constructed in accordance with the invention.

Turning now to the drawings, FIG. 1 is a plan view of one embodiment of a tool and parts tray constructed from a tray body 10 with upturned sides particularly suited for storing hand tools and small parts used in performing repair or maintenance work on a motor vehicle. The plan view of FIG. 1 shows the tray body having four compartments: an elongated first compartment 12, two smaller, generally rectangular compartments 14, 16 and a center circular compartment 18 for storing small nuts, bolts and the like and having a depth less than the other compartments. The compartments are defined by four exterior side walls 22–25, three interior ribs 26–28 and a circular rib 29 that forms the compartment 18. Separate compartment bases **12*a*, 14*a*, 16*a*, 18*a* are spaced from each other by gaps formed by the ribs 26–29**.

Figure 2:
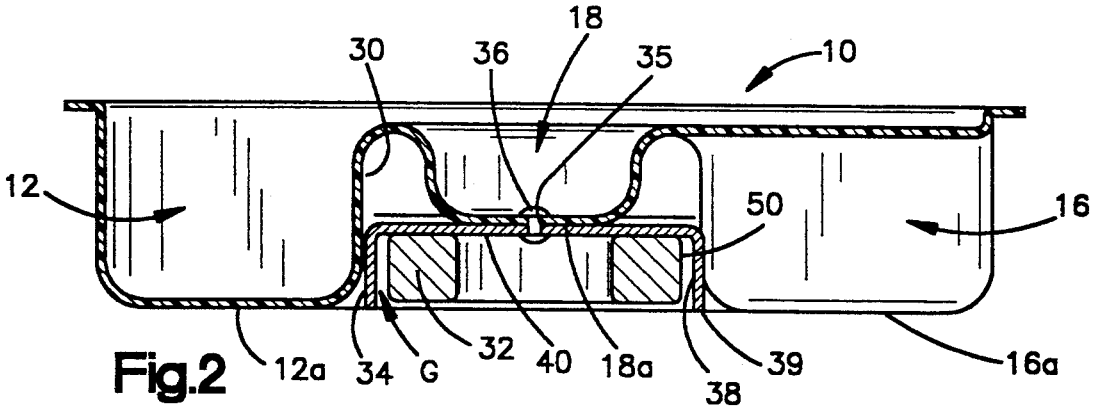
FIG. 2 is a section view as seen from the plane defined by the line 2—2 in FIG. 1.
Figure 3:
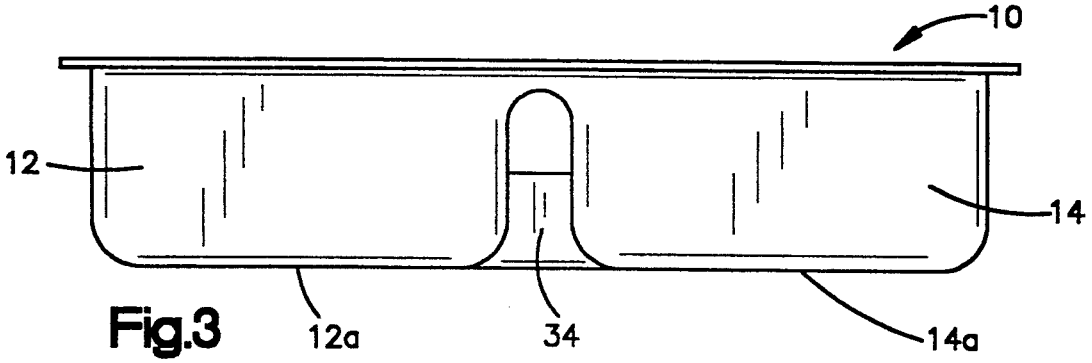
FIG. 3 is an elevation view of the FIG. 1 tray.
Figure 4:
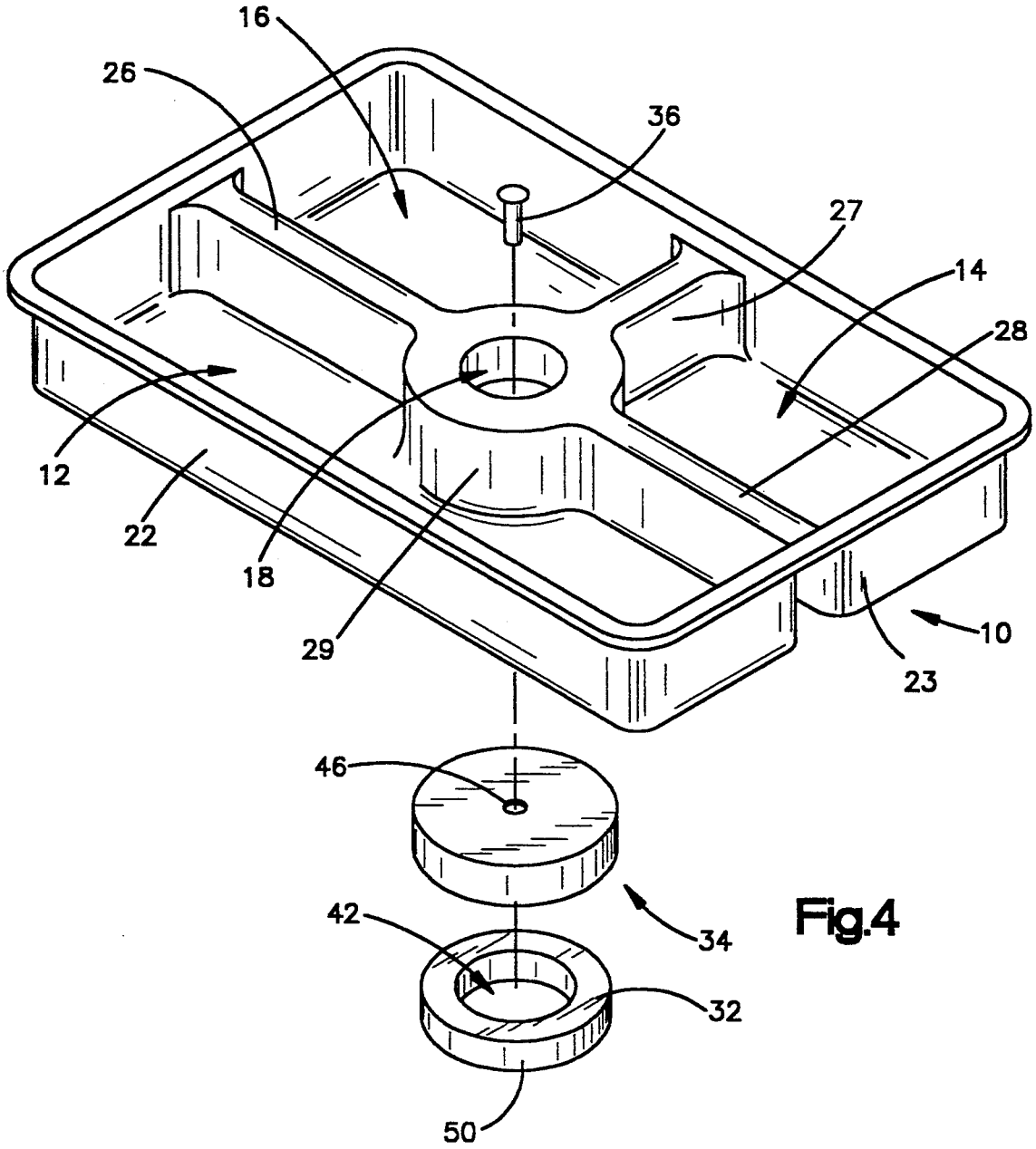
FIG. 4 is an exploded perspective of the FIG. 1 tray.

In one embodiment, the FIG. 1 tool tray body is constructed of a plastic material and is most preferably molded in a one-piece construction. The tray body also defines a cavity 30 configured to accommodate a magnet 32 coupled to a cup-like magnet support 34. A fastener 36 passes through a hole 35 in the center compartment 18 of the tray body and secures the support 34 and attached magnet 32 in the configuration shown in FIG. 2. The support 34 has a cylindrical side wall 38 that ends at a generally circular rim 39 for engaging a surface (not shown) on which the tray 10 rests.

The magnet 32 is disc-shaped and sits within the support 34. The magnet 32 includes a central bore 42 sufficiently large to allow installation of the fastener 36. When assembled, the magnet 32 engages a base 40 of the magnet support and magnetic flux from the magnet 32 passes through the support 34 for magnetic engagement with the surface (not shown) on which the tray is placed.

To assemble the tool tray 10, the magnet 32 is slipped within the support 34 and adhered to the support by means of an adhesive or other means. The magnet and support 34 form a magnet assembly that is inserted into the cavity 30 so that the connector 36 can be slipped through the tray body and the support 34 to secure the magnet 32 to the tray 10. Once assembled, the magnet 32 acts both to fix the tool tray 10 to the surface (not shown) on which it is placed and to retain bolts or screws or small tools in the center compartment 18.

The preferred connector 36 is a rivet which passes through the hole 35 in the floor of the center compartment 18 in the tray body 10 and a hole 46 in the base 40 of the support 34. Preferably, the depth of the center compartment 18 and the height of the side wall 38 are selected so that when the base 40 abuts the center floor of the center compartment 18, the rim 39 is generally co-planar with the tray base 20. The outer diameter of the support 34 is selected relative to the inner diameter of the cavity 30 so that the support 34 may be slid easily into the cavity 30. The preferred connector 36 includes a shaft which passes through the holes 38, 46 and a pair of rounded heads which press the tray 10 and shield 34 together.

The farther the magnet 32 is raised above the surface (not shown) on which the tray 10 is placed, the less will be the field strength of the magnet 32 for holding the tray 10 in place. The best performance is obtained when the height of the floor of the center compartment 18 above the base 20 is selected so that, when assembled, the exposed surface of the support rim 39 is approximately level with the base 20 and the magnet is recessed within the support a short distance of approximately 1/16 of an inch.

The magnet 32 is composed of a suitable magnetic material. The support 34 is preferably a ferromagnetic metal such as iron or steel, but may also be molded from plastic such as that used in molding the tray 10. If the support 34 is ferromagnetic, the support becomes an extension of the magnet so that lines of magnetic flux extend through the support rim 39. If the support 34 is plastic or of a non-ferromagnetic metal such as aluminum, a bottom surface of the magnet should be co-planar with a bottom of the tray body so that the magnet contacts a support surface for the tray. While the cavity 30, magnet 32 and support 34 have been disclosed as circular, these parts may also be of another shape such as square or rectangular.

Other types of connectors, such as screws, may be used to retain the magnet 32 and support 34 in the cavity 30. For example, fastening means may be molded into the tray 10 and support 34 for coupling the support 34 and tray 10 together. In such case, there is no need for a separate connector 36.

In accordance with the preferred embodiment of the invention, a small gap G is maintained between an outer surface 50 of the magnet and the cylindrical side wall 38 of the support 34. Experience with the tool tray indicates that in addition to attracting the tray to a metal surface, the magnet can attract small metal shavings or particles in the vehicle engine compartment. The small particles tend to accumulate within the gap G.

Figure 5:
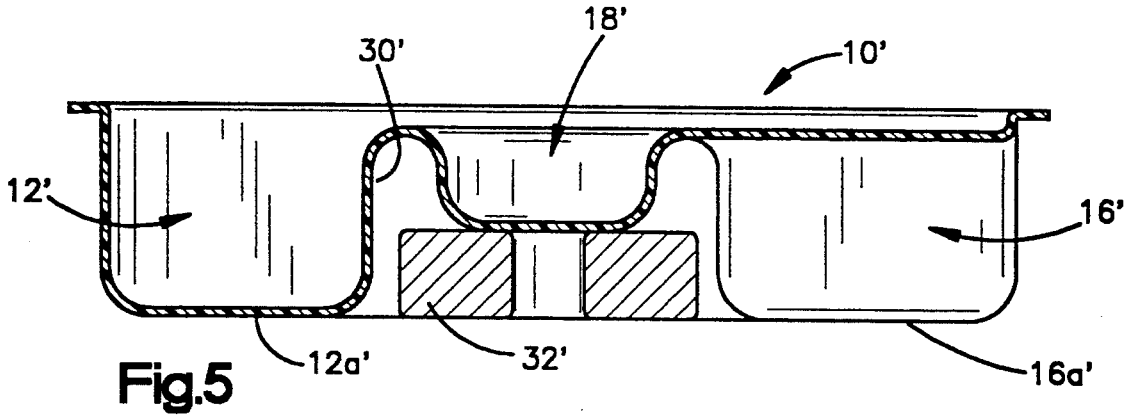
FIG. 5 is a section view of an alternate tool and parts tray.

Turning to FIG. 5, an alternate embodiment of the invention is disclosed in which the tray body 10' is plastic and defines multiple compartments and a magnet 32' is attached directly to a base of a center compartment 18'. In this embodiment, the magnet is attached by means of a suitable gasoline resistant adhesive and, therefore, the connector 36 shown in FIGS. 1–4 is not needed. Unlike the previous embodiment where the magnet 32 was recessed slightly by the support 34, in the FIG. 5 embodiment a base of the magnet 32' is generally co-planar with the compartment bases **12*a'*, 16*a'***.

Figure 7:
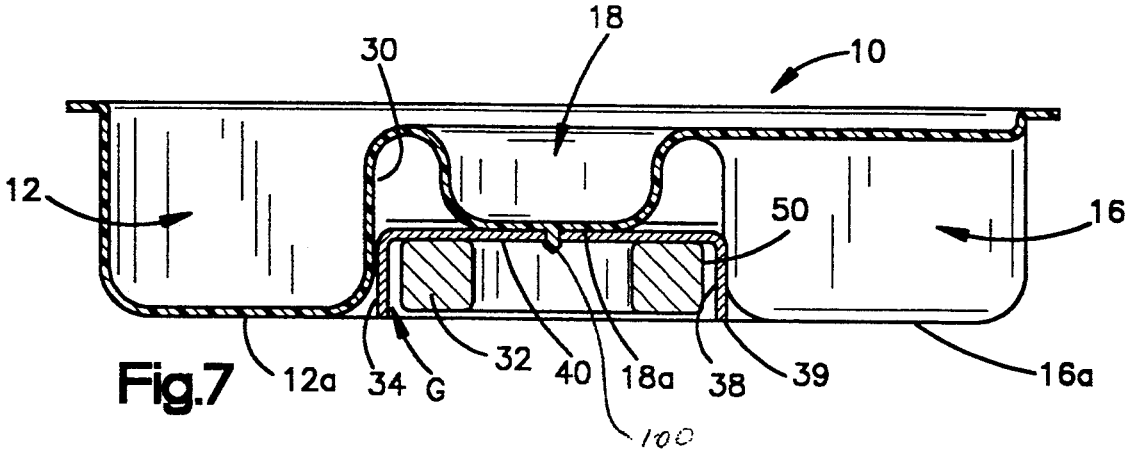
FIG. 7 is a section view of the FIG. 1 tool and parts tray showing an alternate means of attaching the magnet to the tray body.
Figure 8:
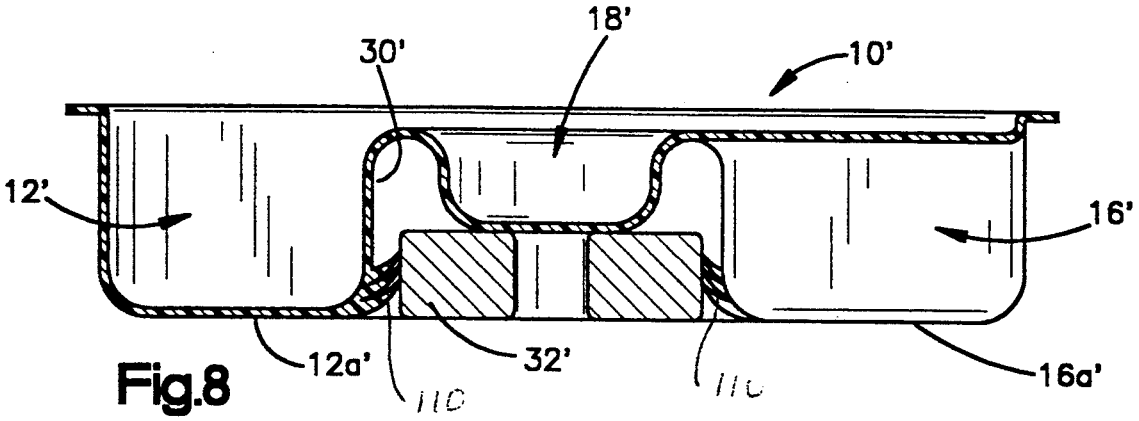
FIGS. 8 and 9 are section views of the FIG. 5 tool and parts tray showing alternate means of mounting a magnet to a tray body.
Figure 9:
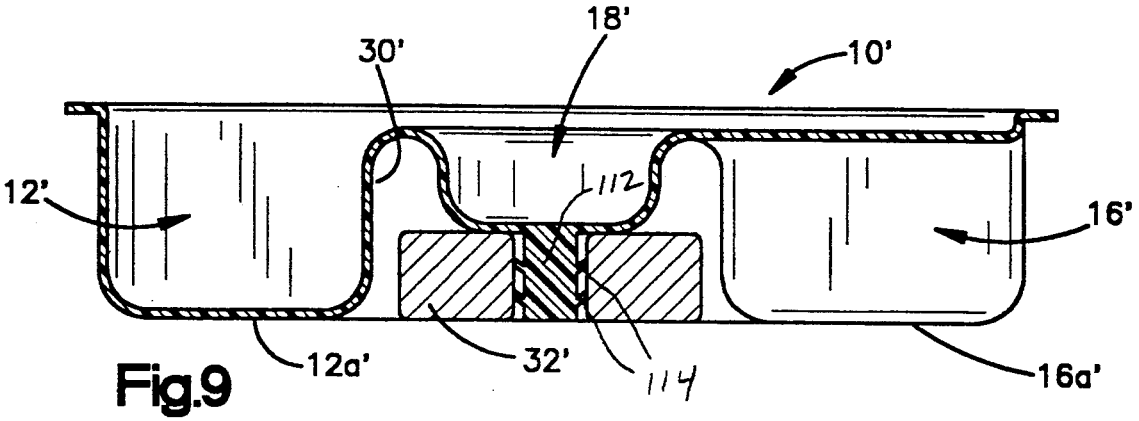

FIGS. 7–9 illustrate alternate tool and parts tray constructions where the tray body includes means for engaging and securing the magnet 32. In FIG. 7, a prong 100 having a deformable tip is pushed through an appropriately configured hole in the support 34. The prong 100 deforms as it is pushed through the support and returns to its original shape so that a lip engages the support surface 40.

In FIG. 8, a plurality of fingers 110 extend inwardly from lower portions of the rib 29. The magnet 32' is pushed into the cavity beneath the compartment 18' and an outer surface of the magnet 32' deforms the fingers 110. In FIG. 9, the bottom of the compartment 18' defines a post 112 having ridges 114 that are deformed as the magnet 32' is pushed over the post 112. Each of the FIGS. 8 and 9 embodiments utilize an upward force exerted by a deformable means against the magnet to secure the magnet in place within its recess.

Figure 6:
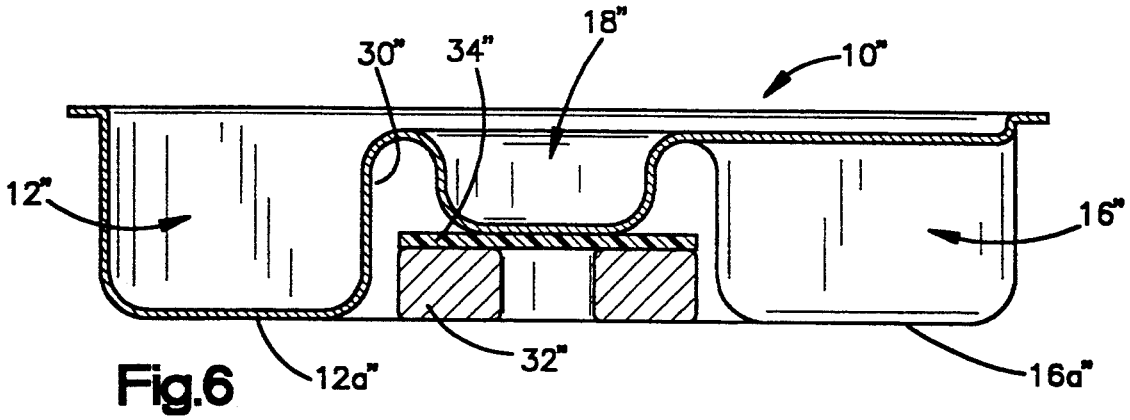
FIG. 6 is a section view of a second alternate tool and parts tray.

Turning to FIG. 6 in this embodiment of the invention, a tray body 10" is disclosed wherein the body is metallic and a magnet 32" is spaced from the metallic body 10" by means of a plastic support 34" interposed between the tray body and a magnet 32". When the tray body is ferromagnetic metal, the magnet must be mounted so that a significant portion of the magnetic field is directed away from rather than toward the tray body. This avoids concentrating the magnetic field in the tray body and weakening magnetic attraction between the surface to which the tool tray is mounted and the magnet. As seen in FIG. 6, the support 34" magnetically isolates the magnet 32" from the tray body by means of a circular spacer material such as plastic or a non-ferromagnetic metal such as aluminum to which the magnet is mounted by an adhesive. The support 34" is then mounted to the metal tool tray body such that the magnet is suitably spaced from ferromagnetic metal portions of the tray with the magnet base co-planar with compartment bases **12*a"*, 16*a"***.

The present invention has been described with a degree of particularity. Many variations on the number and size of the compartments in the tray body would be apparent to those skilled in the art. It is the intent, however, that the invention include all modifications and alterations of the disclosed design falling within the spirit or scope of the appended claims.

What is claimed is:

1. A tool and parts tray comprising:

a) a metal body having side walls, a base, and interior walls defining an elongated compartment for storing tools and a smaller compartment for storing parts, said metal body configured to be placed in close proximity to a work area;

b) a magnetic member to fix the tool tray to a metal surface; and c) a plastic spacer member attached to the metal body and interposed between the metal body and the magnetic member to magnetically isolate said magnetic member from the metal body.

2. The tool and parts tray of claim 1 where the metal body defines a cavity and the magnetic member is an annular magnet that fits within the cavity in spaced relation from the metal body.

* * * * *